US005338276A

United States Patent [19]

Jull et al.

[11] Patent Number: 5,338,276

[45] Date of Patent: Aug. 16, 1994

[54] EXERCISE MONITORING DEVICE

[76] Inventors: Gwendolen A. Jull, 51 Barkala Street; Carolyn A. Richardson, 31 Bruckner Street, both of The Gap, Queensland, 4061, Australia

[21] Appl. No.: 29,737

[22] Filed: Mar. 11, 1993

Related U.S. Application Data

[62] Division of Ser. No. 783,299, Oct. 28, 1991, abandoned.

[30] Foreign Application Priority Data

Jun. 19, 1991 [AU] Australia ..... PK6744

[51] Int. Cl.[5] ..... A63B 21/008

[52] U.S. Cl. ..... 482/113; 482/111; 482/148; 601/23

[58] Field of Search ..... 482/8, 111, 112, 113, 482/131, 148; 128/25 R

[56] References Cited

U.S. PATENT DOCUMENTS

| | | | |
|---|---|---|---|
| 2,823,668 | 2/1958 | Van Court et al. . | |
| 3,492,988 | 2/1970 | Maré | 128/25 R |
| 3,950,799 | 4/1976 | Frank . | |
| 4,135,503 | 1/1979 | Romano . | |
| 4,331,133 | 5/1982 | Arkans . | |
| 4,448,228 | 5/1984 | Hashimoto et al. . | |
| 4,530,496 | 7/1985 | Smith | 482/49 X |
| 4,653,514 | 3/1987 | Shapiro | 482/121 X |
| 4,805,603 | 2/1989 | Cumberland . | |
| 4,915,124 | 4/1990 | Sember, III . | |
| 4,943,053 | 7/1990 | Smith | 482/121 |
| 5,005,826 | 4/1991 | Merrick | 482/112 X |
| 5,033,457 | 7/1991 | Bonutti | 128/25 R |

FOREIGN PATENT DOCUMENTS

| | | | |
|---|---|---|---|
| 1541170 | 2/1979 | United Kingdom | 482/111 |

*Primary Examiner*—Richard J. Apley
*Assistant Examiner*—Lynne A. Reichard
*Attorney, Agent, or Firm*—Panitch Schwarze Jacobs & Nadel

[57] ABSTRACT

An exercise monitoring device ( 10, 10A, 10B) comprising a pressure pad (11) in the form of a flexible bladder or bag which comprises a plurality of substantially separate compartments ( 12, 12A, 12B). There is also included pumping means in the form a pressure bulb or air bulb (24). There is also included feedback means in the form of an aneroid dial (18, 19). The feedback means permits monitoring or metering of pressure biofeedback transmitted to the pressure pad from the body part of the patient (34) in use. The feedback means may also comprise an analogue meter, digital readout or visual display device VDU which are all associated with the pressure transducer. There also may be provided valve means (21) in the form of a regulating screw which may regulate air flow between the air bulb (24) and aneroid dial (18, 19). There is also provided a method for monitoring of physiotherapy exercises using the above described monitoring device (10) which includes the steps of:

(1) supporting the pressure pad (11) between a body part of a patient (34) requiring monitoring and a support surface such as a floor, belt, back of a chair, wall, plinth bed;

(2) inflating the pressure pad (11) until it moulds between the body part and the support surface;

(3) monitoring the pressure on the feedback means including noting any changes in the pressure; and (4) deflating the pressure pad (11).

12 Claims, 2 Drawing Sheets

EXERCISE MONITORING DEVICE

This is a division of application Ser. No. 07/783,299, filed Oct. 28, 1991, now abandoned.

BACKGROUND OF THE INVENTION

This invention relates to an exercise monitoring device which is particularly suited for use in physiotherapy. In particular the monitoring device of the invention is especially directed to "pressure biofeedback" which is to provide feedback to ensure safety, quality and precision in exercise performance and testing.

Hitherto difficulty has been experienced especially in regard to patients in relation to monitoring of patients during physiotherapy exercises to determine if the patient was carrying out the relevant exercises in the prescribed fashion. This was necessary to avoid muscle fatigue, back strain and pain and also to ascertain when the energy of the patient was weakening or when a rest was required. Monitoring of these remedial exercises was also necessary to ensure correct muscle action for example in retraining of the abdominal muscle function and also to ensure safety and precision of stretching techniques. Monitoring of these exercises was also necessary to achieve postural training and for checking stabilisation during exercises lumbar spine (for example stabilisation during lower limb exercise).

Such monitoring as described above has been largely carried out in the past by patient self assessment or by visual or manual assessment by the physictherapist and thus it was largely done on a qualitative rather than a quantitative basis. An electrical device known as an electromyograph which measured electrical activity of the muscles was used to some extent but is difficult to use in the clinic when monitoring many complex muscle actions.

Pressure actuated devices or sphygmomanometers are well known in relation to measurement of arterial blood pressure. These devices comprise a pressure bulb with suitable valves associated therewith, an elongate cuff usually having velcro attachments for fastening to an arm or leg and a pressure bag or bladder usually formed from resilient material retained within a retaining pocket in the elongate cuff. There was also provided an air hose connecting the bulb with the bladder and another air hose connecting the bladder with a suitable metering device. Metering devices normally included an analogue meter (eg mercury manometer or aneroid dial) or digital read out device.

However such sphygmomanometers were not suitable for use as an exercise monitoring device as they were solely directed to measurement of arterial blood pressure.

It therefore is an object of the invention to provide an exercise monitoring device which is suitable in monitoring of physiotherapy exercises which is quantitative in nature.

SUMMARY OF THE INVENTION

Accordingly the invention provides in one aspect an exercise monitoring device including a pressure pad, an air pump, feedback means and an air line associated with the pressure pad, air pump and feedback means to permit inflation of the pressure pad for monitoring purposes.

The pressure pad may be of any suitable form and thus comprise a flexible bladder or bag preferably formed of non-resilient or non-stretchable material inclusive of plastics material such as vinyl, leather or fabric such as cotton or wool.

Although the pressure pad may comprise a single air chamber it is preferred that there are provided a plurality of air chambers separated by boundaries only permitting restricted air access between adjacent air chambers. It is preferred to utilise a plurality of air chambers having restricted air access between the chambers as this allows appropriate monitoring of variable changes (eg rotation) of the patient's body position unlike a single air chamber.

In another embodiment, the pressure pad may be formed of a plurality of completely separate air chambers whereby each chamber has its own air line to provide a plurality of air lines all communicating with a common manifold.

In a preferred embodiment therefore the pressure pad may comprise an air bag which is suitably plate like in shape having a pair of opposed walls wherein adjacent parts of each wall may be fused or welded together so as to form the abovementioned boundaries with openings or air passages between each boundary to provide access of air between adjacent air chambers.

The air pump may be of any suitable kind and suitably comprises an air bulb or pressure bulb which may be actuated or pressurised manually. However this does not preclude the use of other air pumps such as piston pumps or diaphragm pumps for example.

The feedback means may be of any suitable type that permits monitoring or metering of the pressure biofeedback which is transmitted by the pressure pad. This may include an analogue meter for example such as an aneroid dial or electronic or electrically operated meter such as a digital read out or a suitably visual display unit or VDU.

In one form the feedback means may also include a pressure transducer such as a strain gauge or pressure transducer based on a piezo electric effect or variable resistance effect. In the latter arrangement this may operate with one side or face of a membrane incorporating a circuit having the variable resistance being subject to the pressure change which will result in a change in the electrical resistance of the circuit which is related to or proportional to the change.

The pressure transducer may be connected to the pressure pad in any suitable fashion such as by an air hose. The pressure transducer in turn may then be connected to a digital read out or analogue meter or interfaced with a computer which incorporates the VDU which if desired may be coupled to a printer. The computer may use appropriate software so as to provide a thorough analysis of the output of a patient undergoing an exercise routine which may be contained in a suitable print out from the printer.

Preferably for ease and convenience the air bulb is directly coupled to an aneroid dial so that the result on the aneroid dial may be read by the patient undergoing the exercise so as to provide a form of self assessment.

There also may be provided valve means so as to adjust the pressure in the pressure pad if required. In one form this may comprise a screw actuated valve associated with an air passage between the aneroid dial and the air bulb. When the valve is in an open position air may not reach the pressure pad but is pumped directly to atmosphere. When the valve is closed or partially closed air may be pumped to the pressure pad so as to inflate the pressure pad. Further opening of the valve may decrease the pressure in the pressure pad as recorded on the aneroid dial when required.

In another aspect the invention provides a process for monitoring of physiotherapy exercises using the above described monitoring device which includes the steps of:

(1) supporting the pressure pad between a body part of a patient requiring monitoring and a support surface such as a floor, belt, back of a chair, wall, plinth bed;

(2) inflating the pressure pad until it moulds between the body part and the support surface;

(3) monitoring the pressure on the feedback means including noting any changes in the pressure; and (4) deflating the pressure pad.

In relation to step (3) once a constant pressure has been obtained then any deviations from that constant pressure may indicate that the patient is trying too hard or alternatively is not putting the required effort into the relevant exercise.

BRIEF DESCRIPTION OF THE DRAWINGS

Reference may now be made to a preferred embodiment of the invention as illustrated on the drawings attached herewith wherein:

FIGS. 1, 1A and 1B illustrate a first form of exercise monitoring device constructed in accordance with the invention wherein FIG. 1 shows a pressure pad, FIG. 1A shows a front view of an assembly of aneroid dial and air bulb and FIG. 1B shows a side view of this assembly;

DESCRIPTION OF THE PREFERRED EMBODIMENTS

Figure 1:
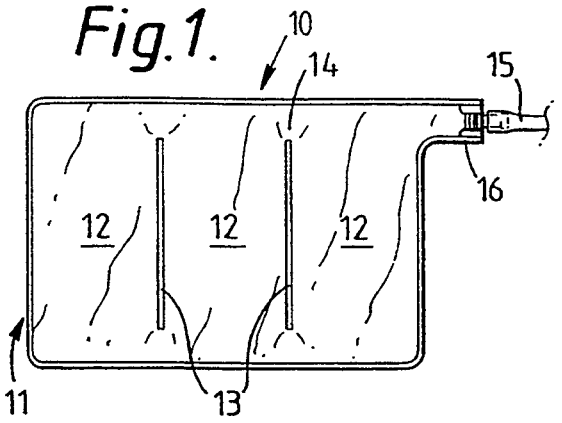
Figure 1A:
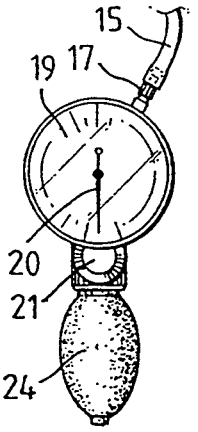
Figure 1B:
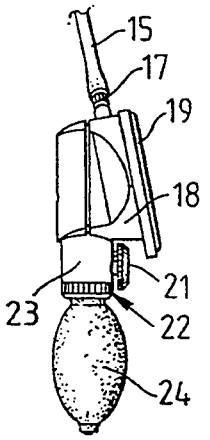

In the drawings and especially in FIG. 1 there is shown an exercise monitoring device 10 having a pressure pad 11 including air compartments or chambers 12 separated by boundaries 13 having restricted air passages 14. An air line 5 is attached to nozzle 16 of pad 11 and is also attached to inlet 17 of aneroid dial housing 18 having gauge 19 and indicator needle 20. There is also shown adjusting screw 21 of regulating valve 22 for adjustment of pressure in pad 11. Air bulb 24 is attached to air passage or inlet pipe 23 of housing 18. There is also included a non-return valve in housing 18 (not shown).

Figure 2:
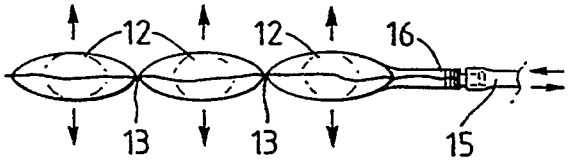
FIG. 2 is an end view of the device shown in FIG. 1.

FIG. 2 shows each chamber 12 may inflate individually after air is forced into pad 11 by pumping of bulb 22.

Figure 3:
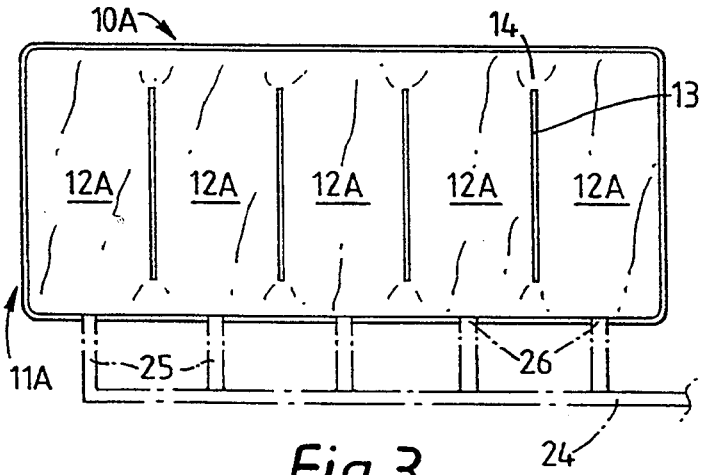
FIG. 3 is a view of a second form of exercise monitoring device constructed in accordance with the present invention.

FIG. 3 shows that an exercise monitoring device 10A having a pressure pad 11A instead of having three chambers 12 as shown in FIG. 1 has five chambers 12A. Also a manifold 24 may be used to interconnect access tubes 25 attached to nozzles 26 of pad 11A.

Figure 4:
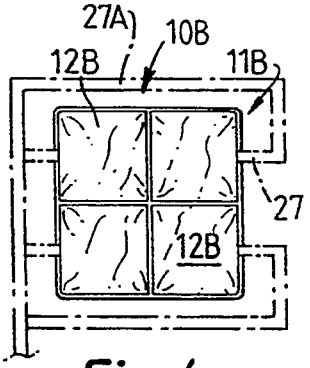
FIG. 4 is a view of a third form of exercise monitoring device constructed in accordance with the present invention.

FIG. 4 shows a monitoring device 10B having pressure pad 11B having a different arrangement of chambers 12B to that previously described each having a separate air line 27. In the FIG. 4 arrangement if each air line 27 is connected to a common manifold 27A then of course there is no requirement for restricted air passages 14 because by the provision of this manifold the air pressure in each chamber 12B will be individually controlled.

Figure 5:
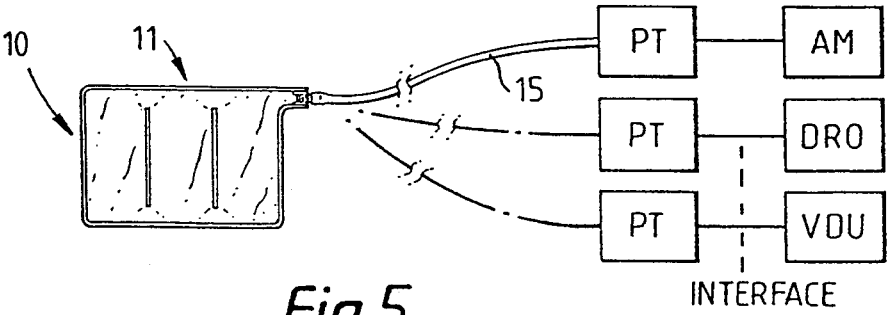
FIG. 5 is a view showing the exercise monitoring device of FIG. 1 connected to a pressure transducer and digital read out or VDU of a computer interfaced with the pressure transducer.

FIG. 5 shows an arrangement where the monitoring device 10 is connected through a pressure transducer PT to an analogue meter AM or digital read out meter DRO or to VDU in separate alternative arrangements. In the VDU arrangement the transducer PT is interfaced with a computer which incorporates the VDU. The transducer PT may communicate with air line 15 in any suitable manner.

Figure 6:
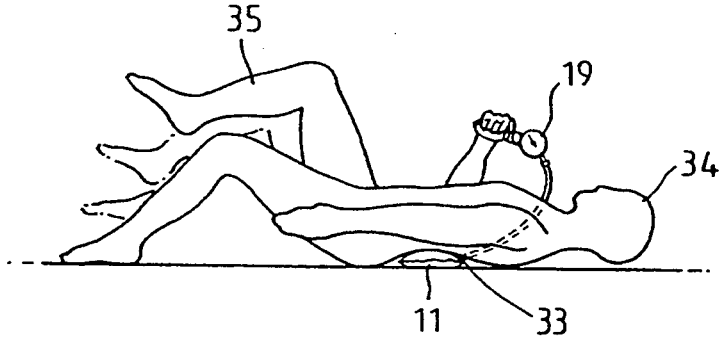
FIG. 6 is a view showing the exercise monitoring device of the invention used for monitoring abdominal muscle training and postural training.

In FIG. 6 pad 11 is placed under the lumbar spine of back 33 of patient 34. The pad may be inflated to mould into the lumbar lordosis and a suitable pressure is within the range of 20 to 46 mm Hg. With emphasis on abdominal muscle contraction the patient upon being requested to flatten the lumbar spine in the back "flattening" manoeuvre should cause an increase of 10–20 mm Hg in the pressure. Higher readings of 30–50 mm Hg may be recorded if the patient is asked to maximally "pelvic tilt". A decrease in pressure denotes increased arching of the lumbar spine and increased anterior pelvic tilt. The action of the abdominals can be monitored for functional strength training and postural correction. The right foot 35 can be elevated in this position to a number of different elevations as shown in phantom. This illustrates controlled leg movement exercises. It will be noted that the patient can monitor his own progress by reading the pressure valve on gauge 19. In another arrangement the patient may stand in an upright position with the pad 11 located against a wall and also abutting the lumbar spine with the patient holding gauge 19 in this hand for appropriate self monitoring of relevant exercises.

Figure 7:
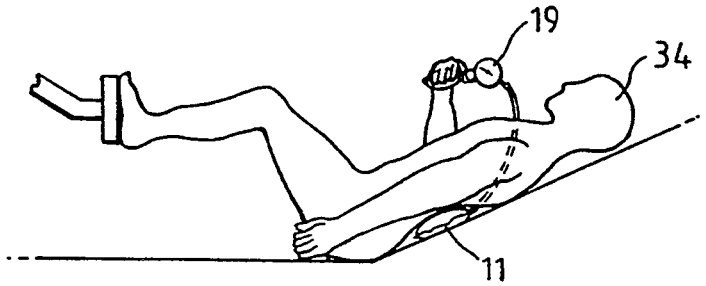
FIG. 7 is a view of the exercise monitoring device of the invention used for monitoring lumbar spine stabilization.

In the position shown in FIG. 7 this is one position suitable for lumbar spine stabilization and thus the appropriate use of the muscles is monitored which are required in the stabilization and protection of the lumbar spine during lower and upper limb exercise. In the stabilization procedure the patient 34 contracts his abdominal muscles and holds his back flat. The pressure may increase 10 to 20 mm Hg when back flattening is performed well. An increase of 30 to 50 mm Hg occurs with back flattening and strong pelvic tilt.

For protection of the lumbar spine the pressure should be maintained during lower and upper limb exercise. A decrease in pressure denotes lack of spinal muscle stabilization.

For more effective exercise with stabilization the pressure should be maintained during leg extension exercises and a decrease in pressure denotes lack of spinal stablization and less effective exercise technique. Relevant exercises in regard to lumbar spine stabilization include leg lifts or lower limb exercise, leg extension or leg press, upper limb exercise or bench press and leg extension exercise which mainly occurs using a slideboard.

Figure 8:
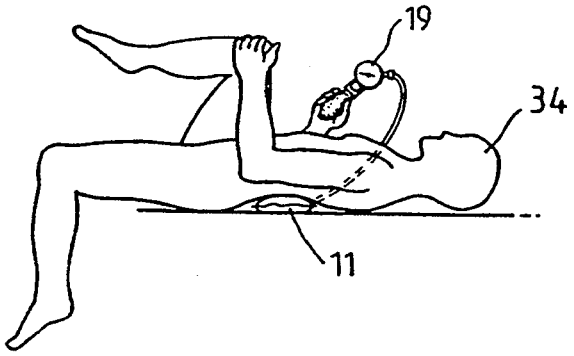
FIG. 8 is a view of the exercise monitoring device of the invention used for monitoring muscle stretching techniques and in particular the hip flexors.
Figure 9:
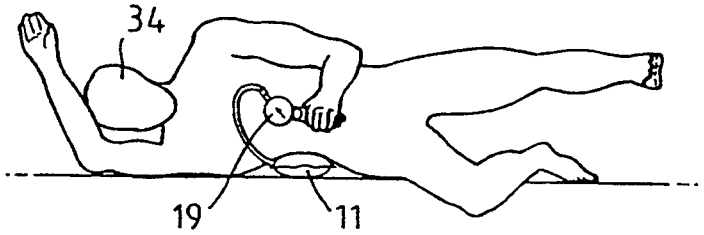
FIG. 9 shows a similar view to FIG. 8 monitoring stretching of the tensor fascia lata muscle.

In the exercises shown in FIGS. 8 and 9 these refer to muscle stretching wherein the monitoring device of the invention allows for estimation of stabilization of the spine while adjacent body segments are moved in order to stretch appropriate muscles. FIG. 8 shows a stretching exercise in relation to the hip flexors, and FIG. 9 shows a stretching exercise in relation to the tensor fascia lata. These tests may also apply to many other stretching techniques including the rectus femoris, the latissimus dorsi and the pectoralis major. In each of these exercises it is necessary to test or stretch the muscle to its limits. It is also necessary to maintain the pressure in the stretch and this can be monitored by the patient 34. In FIG. 8 the pad 11 is placed in the same position as shown in FIGS. 6–7. In FIG. 9 the pad 11 is placed between the lateral trunk (lumbar spine level) and the support surface. The pelvis is stabilized using a lateral pelvic tilt combined with the stabilization procedure.

In the use of the monitoring device of the invention as shown in FIGS. 6–9, pressure on the pad 11 can be increased, decreased or maintained depending upon the exercise. Rotation of screw 21 will deflate pad 11.

It will be appreciated from the foregoing that for the first time a quantitive monitoring of physiotherapy exercises can now take place with the monitoring being handled by the patient which overcomes a lot of the problems associated with qualitative monitoring as described previously.

We claim:

1. A process of self monitoring of physiotherapy or physical therapy exercise which involves muscular movement including stretching of muscles, the process including the steps of:

(a) supporting a pressure pad having a plurality of substantially separate compartment, the compartments being at least partially inflated while in use, the pressure pad being positioned between a body part of a patient requiring such exercise ad a support surface, the pressure pad being connected by an air line to a pressure biofeedback means for permitting monitoring of pressure biofeedback by the patient;

(b) inflating the pressure pad until the pressure pad moulds to the body pat and exerts a monitoring pressure on the body part;

(c) determining and monitoring any deviation in pressure once a constant pressure has been obtained, the determination and monitoring being performed by the patient while the patient performs the exercise; and (d) deflating the pressure pad after the patient completes the exercise.

2. The process of claim 1, wherein the pressure pad is formed of a plurality of air compartments separated by boundaries only permitting restricted air access between adjacent air compartments.

3. The process of claim 1, wherein the pressure pad is formed of a plurality of completely separate air compartments.

4. The process of claim 1, wherein the pressure pad includes valve means of adjusting pressure in the compartments, an assembly of pumping means, and biofeedback means separated by an air passage associated with the valve means.

5. The process of claim 4, wherein the pressure pad further includes an air line between the compartments and the assembly of pumping means and the feedback means.

6. The process of claim 4, wherein the valve means includes a screw actuated valve for selectively controlling the amount of air passing through the air passage.

7. The process of claim 4, wherein the pumping means is a manually actuatable pump and the biofeedback means is an aneroid dial and said air passage is a rigid pipe interconnecting the manually actuatable pump and the aneroid dial.

8. the process of claim 7, wherein the manually actuatable pump is an air bulb or pressure bulb.

9. The process of claim 1, wherein the biofeedback means is an analogue meter coupled to a pressure transducer which is connected to the pressure pad by an air line.

10. The process of claim 1, wherein the biofeedback means is a digital reed out meter coupled to a pressure transducer which is connected to the pressure pad by an air line.

11. The process of claim 1, wherein the biofeedback means is a VDU incorporated in a computer which is interfaced with a pressure transducer which is connected to the pressure pad by an air line.

12. A process of self monitoring of physical therapy exercise which involves muscular movement including stretching of muscles, the process including the steps of:

(a) supporting a pressure pad having a plurality of substantially separate compartments, the compartments being at least partially inflated while in use, the pressure pad being positioned between a body part of a patient requiring such exercise and a support surface, the pressure pad being connected by an air line to a pressure biofeedback means which incorporates meter means, the pressure pad exerting no restraining effect on the body part;

(b) inflating the pressure pad until the pressure pad moulds to the body part;

(c) determining any deviation in pressure once a constant pressure has been obtained, the determination being performed by the patient while the patient performs the exercise and while the meter means is carried by the patient, wherein the pressure biofeedback means monitors or meters the pressure deviations; and (d) deflating the pressure pad after the patient completes the exercise.

* * * * *